US007650960B2

(12) United States Patent
Bock

(10) Patent No.: US 7,650,960 B2
(45) Date of Patent: Jan. 26, 2010

(54) SPEED CONTROL FOR SMALL LOADER

(75) Inventor: Timothy J. Bock, Bismarck, ND (US)

(73) Assignee: Clark Equipment Company, West Fargo, ND (US)

( * ) Notice: Subject to any disclaimer, the term of this patent is extended or adjusted under 35 U.S.C. 154(b) by 220 days.

(21) Appl. No.: 11/682,037

(22) Filed: Mar. 5, 2007

(65) Prior Publication Data

US 2008/0217091 A1 Sep. 11, 2008

(51) Int. Cl.
*G05G 5/06* (2006.01)

(52) U.S. Cl. ..... 180/335; 74/488; 74/489

(58) Field of Classification Search ..... 180/335, 180/19.3, 69.3; 74/488, 489, 490.14, 491–496, 74/523; 123/339.12, 339.25
See application file for complete search history.

(56) References Cited

U.S. PATENT DOCUMENTS

| | | | | |
|---|---|---|---|---|
| 2,072,285 | A * | 3/1937 | Walker | 74/482 |
| 3,876,020 | A | 4/1975 | Barsby | |
| 4,018,104 | A * | 4/1977 | Bland et al. | 74/531 |
| 4,548,094 | A | 10/1985 | Huitema et al. | |
| 5,488,818 | A | 2/1996 | Powers et al. | |
| 5,887,669 | A | 3/1999 | Ostler et al. | |
| 6,832,659 | B1 | 12/2004 | Bares et al. | |
| 6,902,016 | B2 | 6/2005 | Bares et al. | |
| 7,059,434 | B2 | 6/2006 | Bares et al. | |
| 2004/0145134 | A1 | 7/2004 | Bares | |
| 2005/0011696 | A1 | 1/2005 | Bares et al. | |

FOREIGN PATENT DOCUMENTS

EP 1 064 832 A2 1/2001

OTHER PUBLICATIONS

Search Report and Written Opinion dated Jun. 26, 2008 for International application No. PCT/US2008/002850, filed Mar. 4, 2008.

* cited by examiner

*Primary Examiner*—Lesley D Morris
*Assistant Examiner*—Levon Fiore
(74) *Attorney, Agent, or Firm*—John D. Veldhuis-Kroeze; Westman, Champlin & Kelly, P.A.

(57) ABSTRACT

A speed limit assembly for a vehicle includes a cam member having varying thickness, a frictional member, and a handle. The frictional member maintains sufficient frictional forces to resist movement of the cam member during ordinary operation of the vehicle. The handle may be manipulated by an operator of the vehicle to overcome the friction created by the frictional member and move the cam member into a desired position. A portion of a speed control handle on the vehicle abuts against the cam member to define an end of the range of motion of the speed control handle. A desired permitted range of motion may be set by moving the a portion of the cam member having a corresponding thickness into the path of the portion of the speed control handle.

13 Claims, 13 Drawing Sheets

SPEED CONTROL FOR SMALL LOADER

BACKGROUND OF THE INVENTION

The present invention provides a speed control system that may be used, for example, in place of the speed control system disclosed in U.S. Patent Application Publication No. 2005/0011696, which was published on Jan. 20, 2005, and subsequently issued on Jun. 13, 2006 as U.S. Pat. No. 7,059,434.

SUMMARY OF THE INVENTION

In one embodiment, the invention provides a vehicle comprising: an engine; at least one driven wheel rotating under the influence of the engine to move the vehicle; a speed control handle pivotable through a range of motion to control the rate of rotation of the driven wheel, the speed control handle including an engaging portion that moves along a path in response to pivoting of the speed control handle; a cam member having varying thickness, a stop portion of the cam member being the portion of the cam member in the path of the engaging portion of the speed control handle for a given position of the cam member; a frictional member creating sufficient frictional forces to resist movement of the cam member with respect to the rest of the vehicle during ordinary operation of the vehicle; and a handle manipulated by an operator of the vehicle to overcome the friction created by the frictional member and move the cam member into a desired position corresponding to a desired thickness of the stop portion. The engaging portion of the control handle may abut against the stop portion of the cam member to define an end of the range of motion of the control handle such that the range of motion is limited as a function of the thickness of the stop portion.

In another embodiment, the invention provides a speed limit assembly for a vehicle having a support plate with first and second sides, and a speed control handle pivotable through a range of motion, the speed control handle having an engaging portion. The assembly comprises: a cam member having varying thickness, a portion of the cam member in the path of the engaging portion of the speed control handle being a stop portion, the cam member being movable to adjust the portion of the cam member acting as the stop portion; a frictional member coupled to the cam member and abutting against the first side of the support plate to create sufficient frictional forces to resist movement of the cam member with respect to the support plate during ordinary operation of the vehicle; and a handle manipulated by an operator of the vehicle to overcome the friction created by the frictional member and move the cam member into a desired position corresponding to a desired thickness of the stop portion. The engaging portion of the control handle may abut against the stop portion of the cam member to define an end of the range of motion of the control handle such that the range of motion is limited as a function of the thickness of the stop portion.

In another embodiment the invention provides a method for limiting the range of motion of a speed control handle. The method comprises the steps of: (a) providing a cam member having variable thickness; (b) defining a stop portion of the cam member as the portion of the cam member in the path of an abutment portion of the speed control handle for a given position of the cam member; (c) holding the cam member in a first position with frictional forces to maintain a first stop portion in the path of the abutment portion, the first stop portion having a first thickness; (d) defining a first end of the range of motion of the speed control handle upon contact of the abutment portion with the first stop portion; (e) overcoming the frictional forces through a handle to move the cam member into a second position corresponding to a second stop portion being in the path of the abutment portion; and (f) defining a second end of the range of motion of the speed control handle upon contact of the abutment portion with the second stop portion, the second end being different from the first end.

Other aspects of the invention will become apparent by consideration of the detailed description and accompanying drawings.

DETAILED DESCRIPTION OF THE PREFERRED EMBODIMENTS

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following description of FIGS. 1-9 is taken in substance from prior art U.S. Patent Application Publication No. 2005/0011696, which was published on Jan. 20, 2005, and subsequently issued on Jun. 13, 2006 as U.S. Pat. No. 7,059,434.

Figure 1:
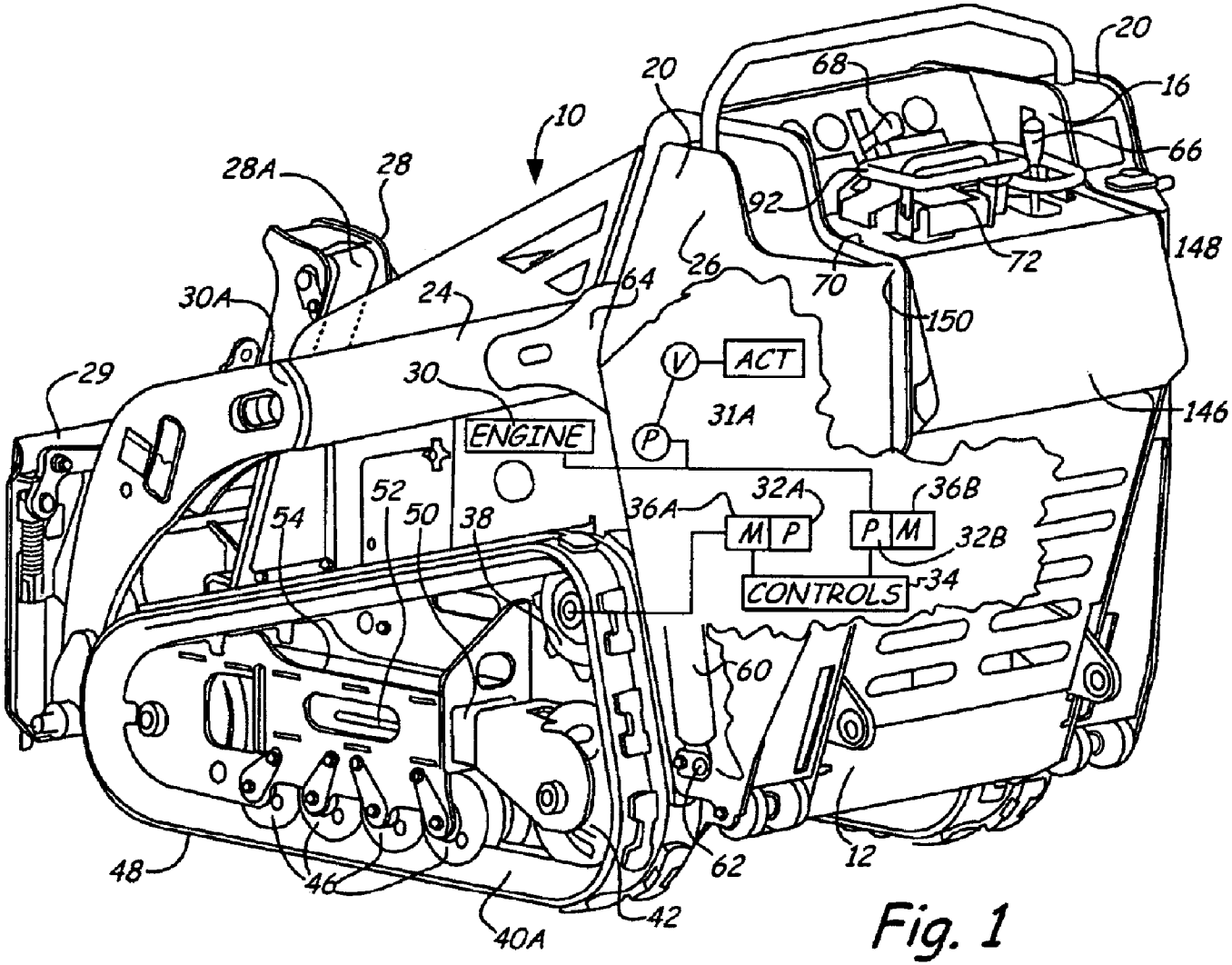
Fig. 1 PRIOR ART
FIG. 1 is a fragmentary rear perspective view of a typical loader utilizing prior art controls.
Figure 2:
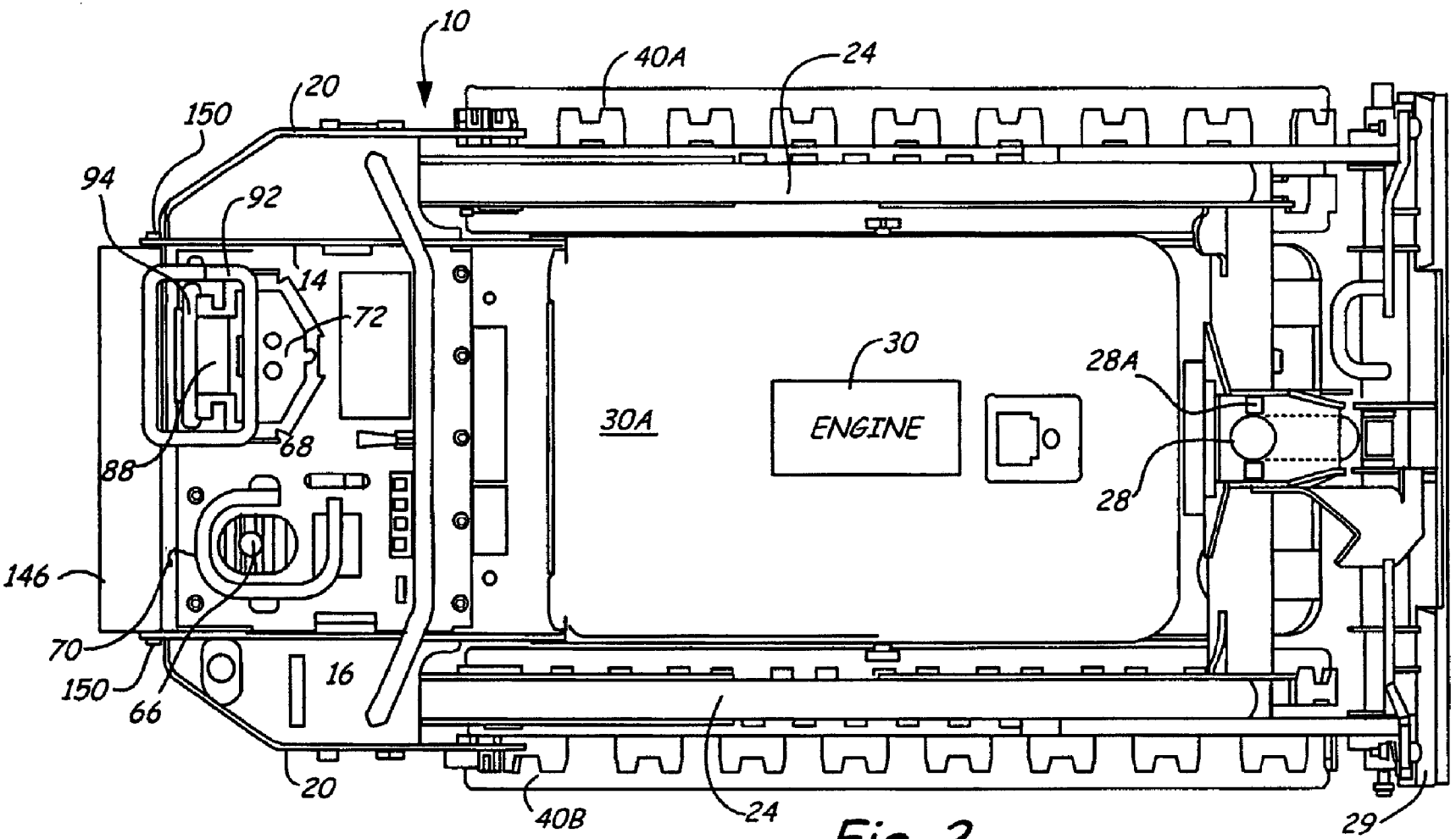
Fig. 2 PRIOR ART
FIG. 2 is a top plan view of the loader of FIG. 1.
Figure 3:
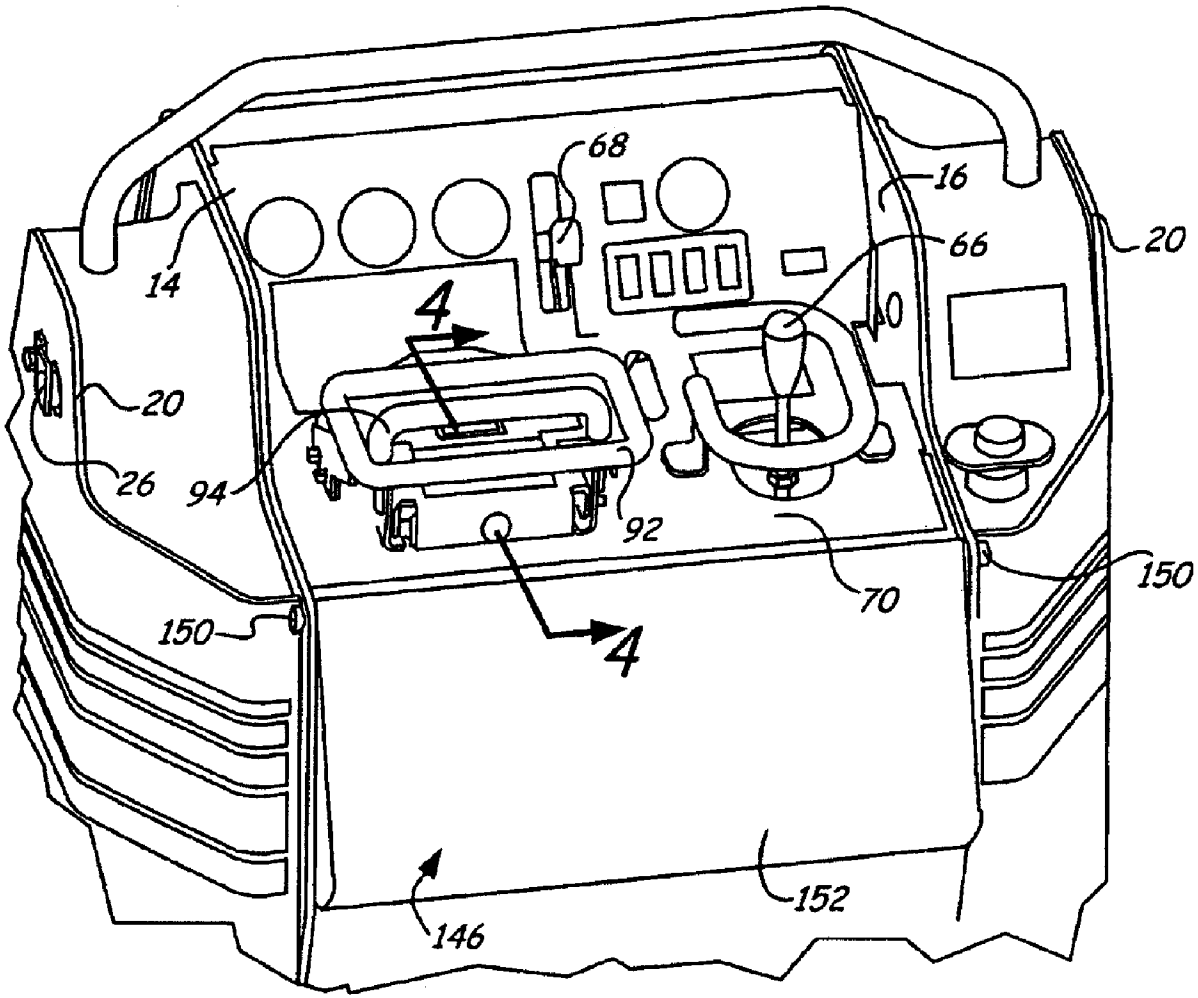
Fig. 3 PRIOR ART
FIG. 3 is an enlarged rear perspective view of the control mounting on the loader of FIG. 1.

FIGS. 1 and 2 illustrate a small self-propelled walk-behind skid steer loader 10. This type of a loader is shown in U.S. Pat. No. 6,832,659 for a loader frame and bolt-on track drive, the disclosure of which application is incorporated by reference. The loader or other vehicle can have a ride on platform attached at the rear as shown in U.S. Patent Application Publication No. 2004/0145134 A1, published on Jul. 29, 2004, also incorporated by reference. The terms "loader" and "vehicle" are intended to include various self-propelled vehicle arrangements, and includes vehicles that have steerable wheels, as well as skid steer arrangements. The zero turn radius machines that are common in lawn and garden application can be controlled with the present invention and are included in the term "vehicle."

The loader has a frame 12 that supports upright frame plates 14 and 16 on opposite sides of the loader. The plates 14 and 16 are part of the frame 12 and are joined with cross plates as needed, and can include lower cross plates that can form an operator's platform at the rear if desired.

The rear portions of the loader have side plates 20 that are spaced from and parallel to the frame plates 14 and 16. The spaces between the side plates 20, and the respective frame plates 14 and 16 are used for mounting a lift arm assembly 24. The lift arm assembly 24 is pivotally mounted as at 26 to the frame 12 and positioned in a desired location. The lift arm assembly 24 has individual lift arms, as shown, and a mast 28 is used for mounting a bucket control or tilt cylinder 28A for a loader bucket, or for other accessories that may be mounted on an attachment plate 29 at the front end of the lift arms.

The loader 10 has an internal combustion engine 30 mounted at an engine housing or compartment 30A that is used for driving a hydraulic pump 31 for the lift and tilt actuators 60 and 28A acting through suitable valves 31A. Auxiliary actuators also can be provided. Also, the engine drives pumps 32A and 32B, which are a part of a swash plate pump and motor unit as conventionally used.

The pump and motor units form ground drive systems including a motor and motor controls, which drive system can be electric or other types of controlled drive.

Hydraulic fluid under pressure from pumps 32A and 32B is provided to unitarily mounted motors 36A and 36B, respectively. The output of the pumps can be varied for speed control, and also reversed. The controls 34 include pump controls that are mounted right at the unitary pump and motor units. The pumps 32A and 32B are swash plate type pumps that are controllable to vary an output to in turn drive the associated motor in a selected direction of rotation, as well as varying the speed of the motor rotation. Movement of the pump control levers, which will be shown subsequently, determines the direction of rotation and speed of the associated motor. The motor speed and direction is thus controlled by the position of the controls 34.

The motors 36A and 36B are used for propelling the loader by individually driving drive sprockets 38, on the sides of the machine, to in turn drive tracks 40A and 40B that are mounted on the sides of the loader. Tracks 40A and 40B are shown in FIG. 2. Wheeled loaders or vehicles would be driven with normal mechanical drive trains to the wheels, or can be operated with ground engaging wheels mounted right on motor shafts.

The tracks mount over suitable idler rollers, including a rear idler roller 42, as shown in FIG. 1. The tracks are supported on the ground with bogie wheels 46 that hold the lower reach or length 48 of the track in a suitable orientation.

The tension in the track is maintained with the slide 50 that mounts rear idler roller 42 and which is loaded with a spring 52 in a housing 54 attached to the track support frame on each side of the loader. A front idler roller is used for mounting the front end of the track.

Schematically shown is a hydraulic cylinder 60 that is typically used for raising and lowering lift arms, and which can be attached to the loader frame at the lower end shown at 62, and attached to the lift arms at a pivot on a bracket 64.

The control system that is shown generally at 34 (FIG. 4) is a drive and steering control assembly using a single control handle, so that an operator can steer and control speed and direction of movement of the loader with one hand, if desired, in a convenient manner. The controls are shown in more detail in FIGS. 2-8. It should be noted that a lever 66 can be provided for controlling the lift arm cylinder 60, and the valves for controlling other cylinders can be controlled as desired. A throttle 68 is provided for controlling the engine speed of engine 30.

Figure 5:
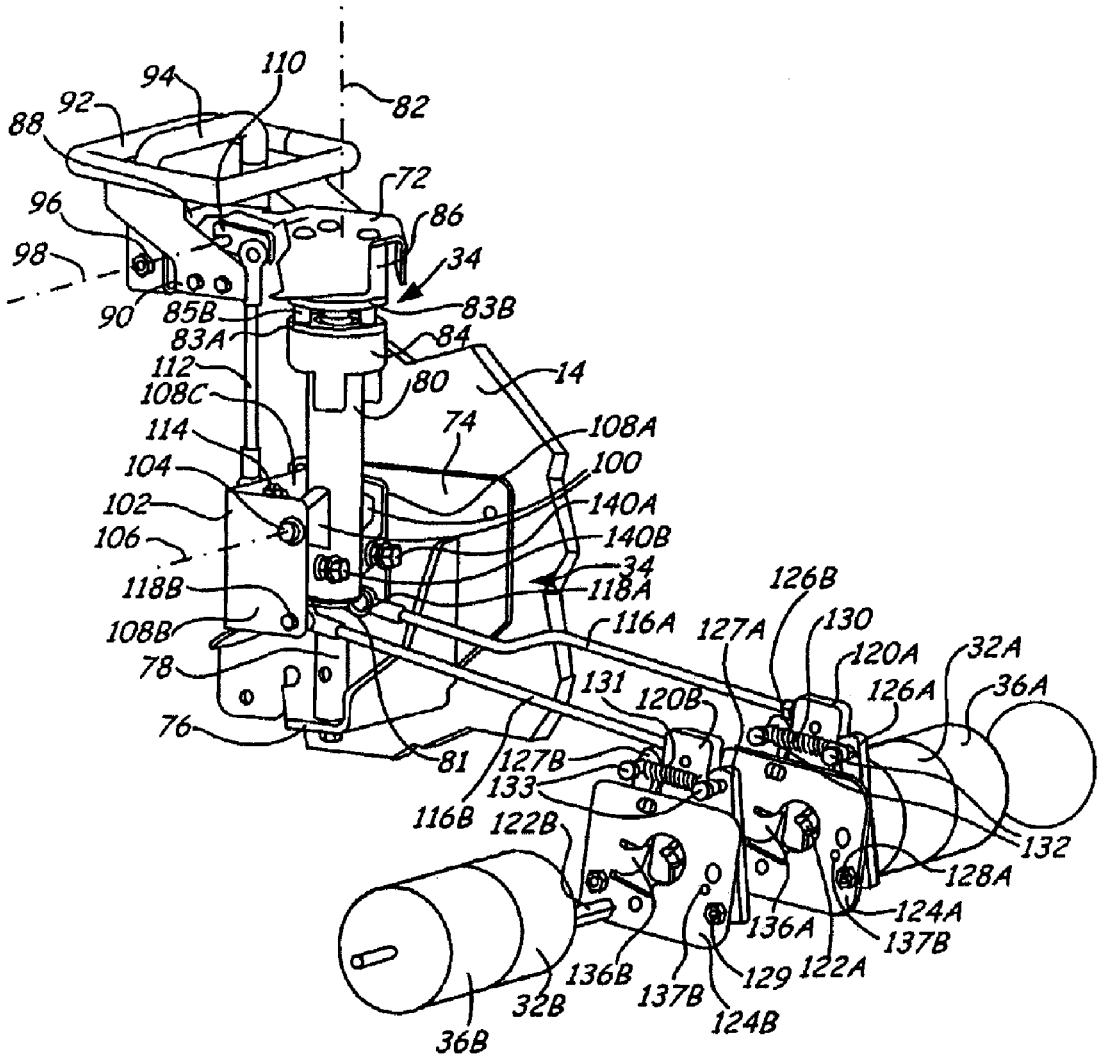
Fig. 5 PRIOR ART
FIG. 5 is a fragmentive perspective view of the control arrangement, viewed in opposite direction from FIG. 4 with the loader shown only fragmentarily and with parts omitted for sake of clarity.

The controls 34 form an assembly supported relative to a control panel 70. The controls include a swinging or movable control handle support plate or platform 72. As shown in FIG. 5, for example, the side plate 14 of the loader has a main mounting bracket 74 supported thereon. The main mounting bracket 74 has a lower mounting flange 76 that extends laterally from the side plate 14. A vertical shaft 78 has a lower end supported on the flange 76. The shaft 78 extends upwardly and can be rotatably supported at the upper end in a suitable manner, relative to the side plate 14 or with a bracket to panel 70, which is fixed to the side plates. The shaft 78 is positioned at a desired location to position and mount the control support plate 72 in its proper location. The shaft 78 does not move relative to the frame except to rotate, and does not have to be vertical. It can incline somewhat for convenience.

The shaft 78 forms a main mounting support for the control assembly 34, and as can be seen in FIGS. 4-7, a sleeve or hub 80 is rotatably mounted on the shaft 78. The sleeve 80 is located in position axially along the shaft 78 with bearings held in place in a suitable manner, for example, with snap ring assemblies indicated at 81. The sleeve 80 is free to rotate about the axis 82 of the shaft 78. A hub 84 at the upper end of sleeve 80 has threaded bores receiving cap screws 81 for holding a support block 86 that mounts the control support plate 72, using suitable fasteners.

The control support plate 72 is securely fixed relative to the sleeve 80, so it will rotate about the axis 82 with the sleeve. The control support plate 72 extends rearwardly from axis 82 and has a control handle mounting section 88. The control handle mounting section 88 has side arms 90 fixed thereto and the side arms 90 in turn mount a fixed four sided reference bar or hand rest 92 that defines a center space and surrounds a movable control handle 94 located in the center space. The control handle 94 is pivotally mounted on a pivot shaft 96 to the handle mounting section 88 of the control support plate 72. The pivot shaft 96 is at the rear of the control support plate 72 and behind axis 80. The handle 94 will pivot about a generally horizontal axis 98 of shaft 96, which is transverse to and preferably perpendicular to axis 82. Handle 94 also can be moved about the axis 82 of upright shaft 78 from side to side, to cause the sleeve 80 to rotate as well.

The sleeve 80 has a pair of ears 100 that extend laterally from the sleeve near the lower end. A pivoting channel shaped bracket 102 is mounted on the ears 100 with suitable pivot pins 104 so that channel bracket 102 will pivot about a generally horizontal axis 106 of pins 104, that is parallel to the pivotal axis 98 of the control handle 94. The channel shaped bracket 102 extends downwardly from the pivot pins 104 and axis 106. The side walls 108A and 108B of channel shaped bracket 102 extend rearwardly from pivot pins 104 so that a base or cross wall 108C that joins wall 108A and 108B is spaced from sleeve 80.

Figure 4:
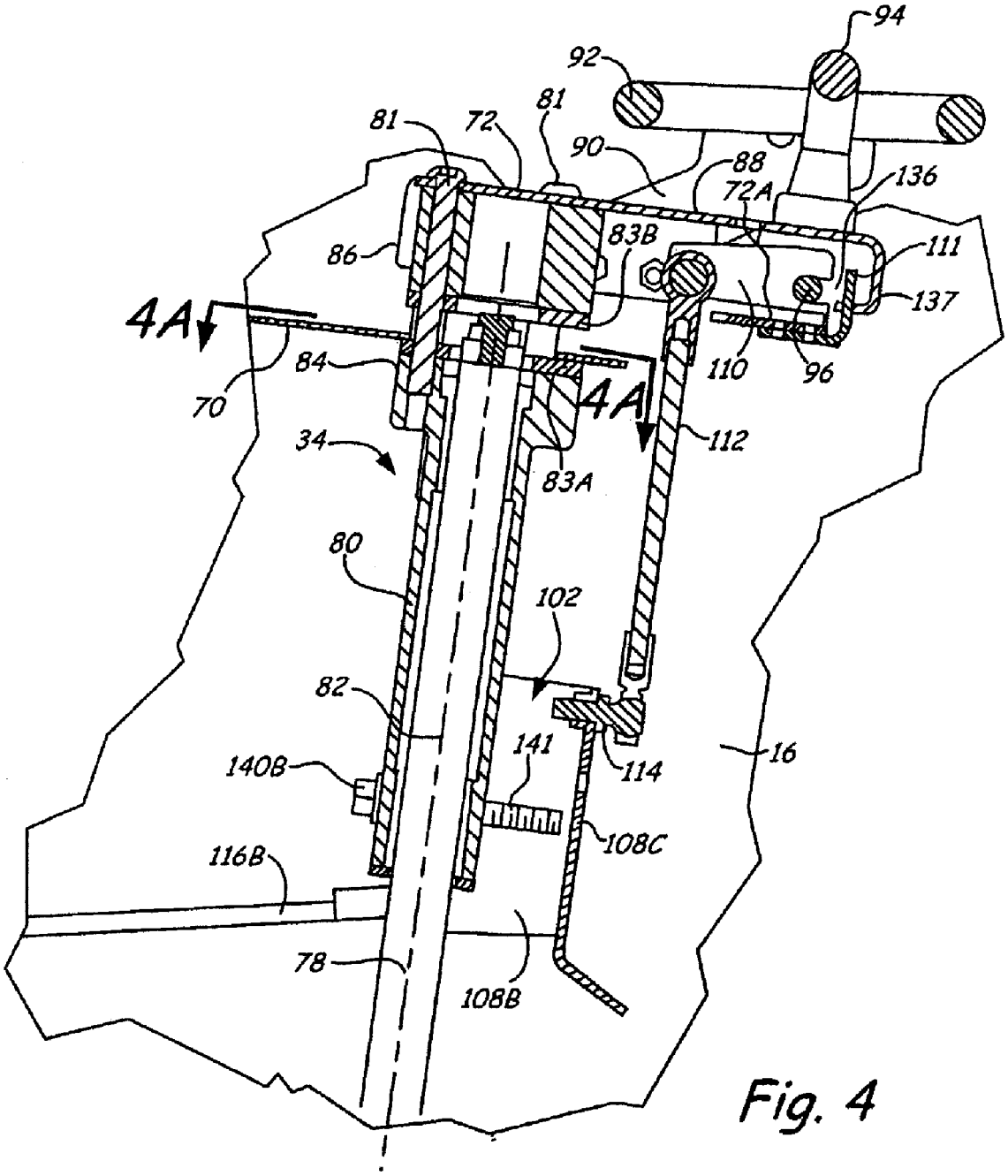
Fig. 4 PRIOR ART
FIG. 4 is a cross sectional view taken along line 4-4 in FIG. 3.
Figure 4A:
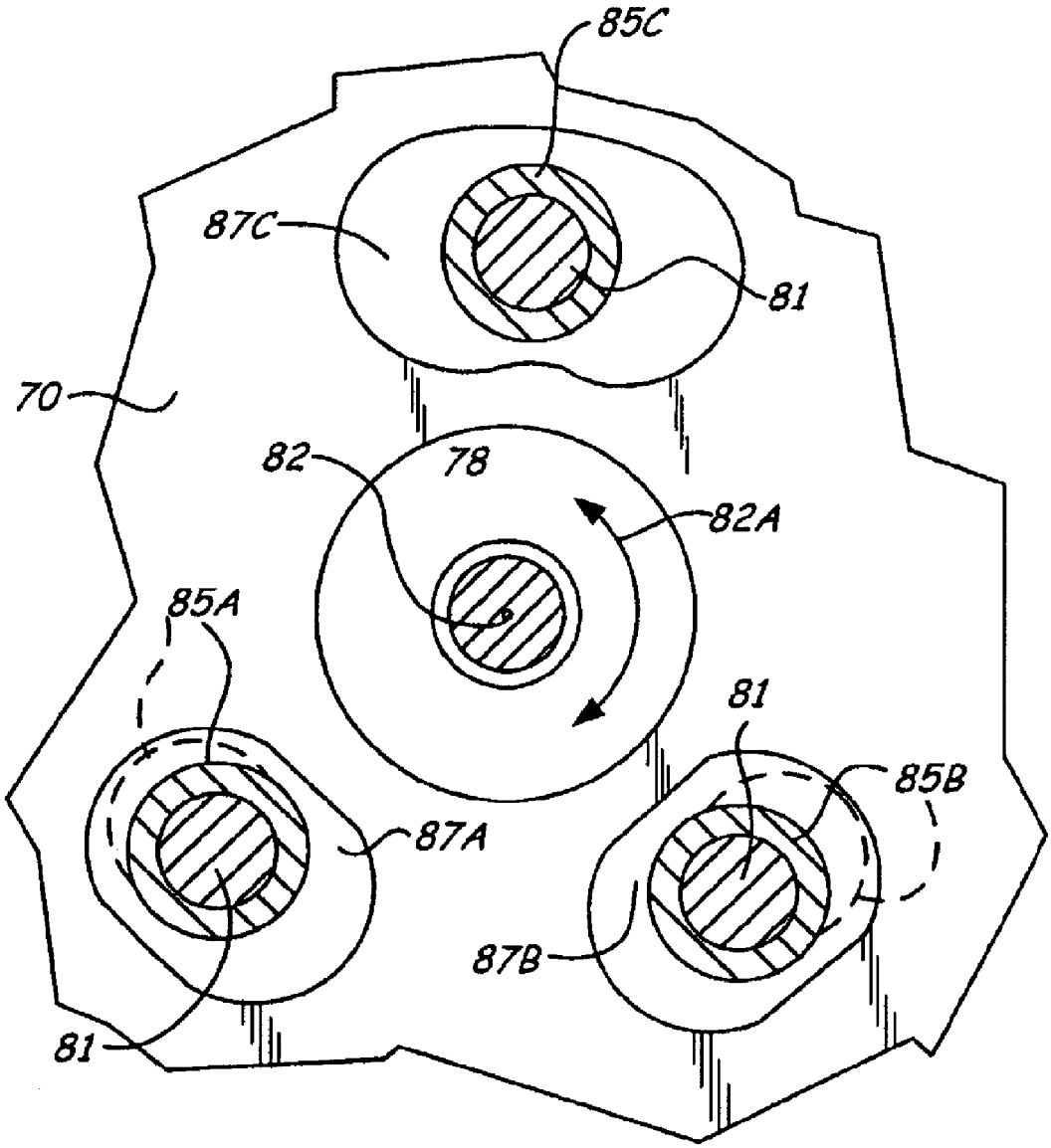
Fig. 4A PRIOR ART
FIG. 4A is a fragmentary sectional view taken along line 4A-4A in FIG. 4.

The extent of the differential motion between the drives on the opposite sides of the vehicle is preferably limited with cooperating stops. The support block 86 is supported on washer plates 83A and 83B separated by spacers 85A, 85B and 85C which pass through slots 87A-87C in the fixed control panel 70. As shown in FIG. 4A, the slots 87A and 87B are shaped and of length to provide steering speed stop surfaces when the support plate is pivoted about axis 82 of shaft 78. The steering motion is indicated by arrow 82A in FIG. 4A. The front slot 87C is longer and does not form a stop surface. The spacers 85A and 85B will contact one end surface of the respective slots 87A and 87B for the stopped positions.

Movement of the bracket 102 about the pivot pins 104 and thus the axis 106 is controlled by the control handle 94 pivoting about the parallel axis 98. The control handle 94 has a forwardly extending arm or lever 110 that is moved by the handle. A first end of a link 112 is connected to the arm 110. The link 112 also has a second end connected as at 114 to the upper portion of cross wall 108C of the bracket 102. Thus, when the handle 94 is pivoted, the arm 110 will move up and down, and will cause the bracket 102 to pivot about the axis 106. This will then cause the lower ends of the side walls 108A and 108B to move in an arc extending in fore and aft directions relative to the frame of the loader. This movement provides direction and speed control inputs to the drive system.

Movement of the lower corners of the side walls 108A and 108B is used to control the individual pump and motor units. In order to do this, a first link 116A and a second link 116B are connected at pivots 118A and 118B to the lower corners of the walls 108A and 108B, respectively. These links 116A and 116B in turn extend downwardly and are connected to control levers 120A and 120B of the pumps 32A and 32B that in turn control the motors 36A and 36B. The levers 120A and 120B are control levers of the purchased pump/motor assembly for swash plate controlled motors and form drive system control levers. The motors 36A and 36B are suitably mounted to the loader frame, so that the motors are fixed in position.

The motors 36A and 36B in turn have drive sprockets on output shafts that are used for driving the respective tracks in a conventional manner. The pumps 32A and 32B have control shafts shown in section in FIG. 5 for example at 122A and 122B that are part of a conventional pump/motor assembly. The levers 120A and 120B are mounted on the pump control shafts, and when the levers 120A and 120B are moved, the shafts 122A and 122B are also rotated to adjust the position of the swash plates of the pumps. The position adjustments are built-in controls of the pumps 32A and 32B and thus, the motors 36A and 36B. Moving the levers 120A and 120B from a centered position causes the motors to rotate in a corresponding direction and at a speed proportional to the displacement of the levers 120A and 120B from center.

The control levers 122A and 120B are spring loaded to be centered by a separate spring return lever arrangement for each of the pump and motor units. Plates 124A and 124B are used for supporting the centering levers and springs. The plates 124A and 124B are supported relative to the pump and motor units with suitable fasteners or the plates can be mounted directly to the loader frame, if desired. The plates 124A and 124B are fixed and each plate pivotally mounts a pair of spring loaded centering or return levers. Levers 126A and 126B are pivoted on plate 124A and levers 127A and 127B are pivotally mounted on plate 124B, for centering the pump control levers 120A and 120B of the respective pump and motor units, which centering action returns the pumps and thus the motors to a stopped or neutral position.

The levers 126A and 126B are pivoted onto the plate 124A at pivots 128 and levers 127A and 127B are pivoted on plates 124B at pivots 129. A spring 130 is connected between pins 132 on levers 126A and 126B. A separate spring 131 is attached in a suitable manner onto pins 133 on levers 127A and 127B. The springs 130 and 131 each provide a spring load tending to urge the upper ends of the respective pairs of spring centering levers 126A and 126B, and 127A and 127B together. This action will move the respective pump control lever 120A and 120B to a centered position.

The upper ends of the pair of spring centering levers 126A and 126B bear against the opposite edges of pump control lever 120A. The upper ends of the pair of spring centering levers 127A and 127B bear against the opposite edges of pump control lever 120B.

The spring centering levers are stopped from moving together when they reach the centered position of the lever. For example, levers 126B and 127B engage stops 136A and 136B. The spring centering levers 126A and 127A engage stop pins 137A and 137B that protrude out from plates 124A and 124B to form a stop for these levers. The stops prevent movement of one lever toward the other lever of the pair beyond the positions shown in FIG. 5. Thus, if the pump control lever 120A moves rearwardly from the position of FIG. 5, centering lever 126B would move rearwardly as well, and since centering lever 126A is against stop pin 137A, the spring 130 would extend. As soon as the external force (on lever 94) causing the lever 120A to move is relieved, the spring 130 would force control lever 120B and control lever 120A back to the neutral position of FIG. 5. Spring 131 acts in the same manner to center the levers 127A and 127B.

A spring return to a centered position for the motor control levers 120A and 120B is provided in a similar manner in both directions of movement of the pump control levers which in turn control the drive motors. The motor control levers are in a neutral or no-drive position when centered.

A feature of having the spring centering or return to neutral function right at the pump and motor drive units is that if a control link becomes unfastened or loose, the motor will be stopped by the spring centering, right at the pump or motor control. This same centering of control levers or valves can be used for different forms of drives.

Movement of the drive system or pump control levers 120A and 120B in fore and aft directions is caused by moving the control handle 94 about the axis 98, or pivoting the handle mounting portion 88 of the support plate 72 about the axis 82. Axis 82 is ahead of the pivot shaft 96 and the control handle 94, so that the control handle 94 will swing from side to side when the support plate 72 is pivoted about the axis 82.

It can be seen, therefore, that if the control handle 94 and support plate 72 are swung to the right or left about the axis 82, there will be differential movement in fore and aft directions of the side walls 108A and 108B which provide steering inputs. In other words, if the movement was clockwise about the axis 82, as shown in FIG. 5, the side wall 108B would move rearwardly and the side wall 108A would move forwardly. This would cause corresponding movement of links 116A and 116B and also the control levers 120A and 120B. There would be a differential in the movement of direction of rotation and drive speed of the motors controlled by the respective control levers 120A and 120B. One of the centering levers for each pump control lever would be moved to stretch the spring for that pair of centering levers. When the control handle is moved back toward center or is released, the centering levers and springs return the pump control levers to center. Movement of control bracket 88 in a counter-clockwise direction about the axis 82 would result in the opposite movements of the walls 108A and 108B and the respective pump control levers 120A and 120B, so that the motors would again operate in different directions and this would cause steering control for the vehicle driven by the motors.

If the vehicle being controlled has steerable wheels, the movement about the upright axis 82 can be used to operate a power steering valve for steering ground engaging wheels, and if such links are mounted to be pivoted about axis 106, the fore and aft movement of the lower ends of bracket 102 could have separated links used only for fore and aft movement and speed control. The steering and drive and speed control links would thus be separated.

Movement of the control handle 94 about the axis 98 with the control plate 72 centered will cause the link 112 to move up or down. Assuming that the control handle 94 is moved forwardly or in a forward direction, the link 112 would move down causing the bracket 102 to pivot about the axis 106 so that the pivots 118A and 118B and links 116A and 116B would move forwardly and simultaneous movement of the pump control levers 120A and 120B in a forward direction would result. The centering levers 126A and 127A would also move forwardly. The centering levers 126B and 127B are against stops 136A and 136B, so the springs 130 and 131 would be loaded.

Opposite movement of the control handle 94 would cause opposite movement of the pump control levers 120A and 120B through the movement of bracket 102 and the links 116A and 116B.

When the control handle 94 is released, the springs 130 and 131 acting on the spring centering of return levers will cause the pump control levers 120A and 120B to return to the neutral position.

If desired, the amount of movement of the control handle 94 in a reverse (or forward) direction can be controlled so that the maximum speed of movement of the loader in a longitudinal direction can be limited. As shown, reverse speed is limited, but forward speed can be limited by stopping movement of the control handle 94 in an opposite direction. Adjustable stops for limiting speed in both directions of movement also can be used. A mechanical adjustment member is provided which engages the operating linkage in a suitable manner to provide a stop for limiting the amount of movement of the control handle 94 when moving the loader in the selected direction.

Figure 7:
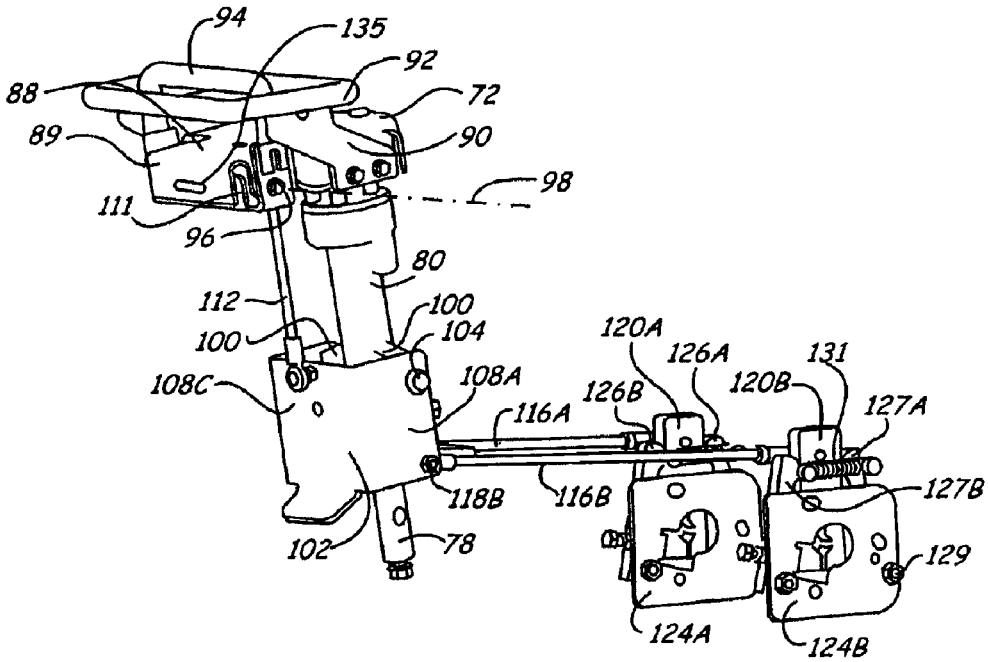
Fig. 7 PRIOR ART
FIG. 7 is a rear perspective view of the control system as shown in FIG. 5.
Figure 8:
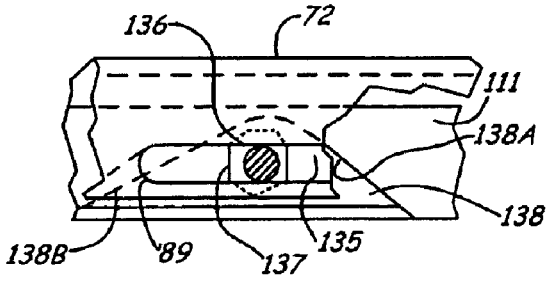
Fig. 8 PRIOR ART
FIG. 8 is a schematic fragmentary view of the rear flange of the control handle support platform showing a prior art adjustment for changing the maximum rearward displacement of the control handle.
Figure 9:
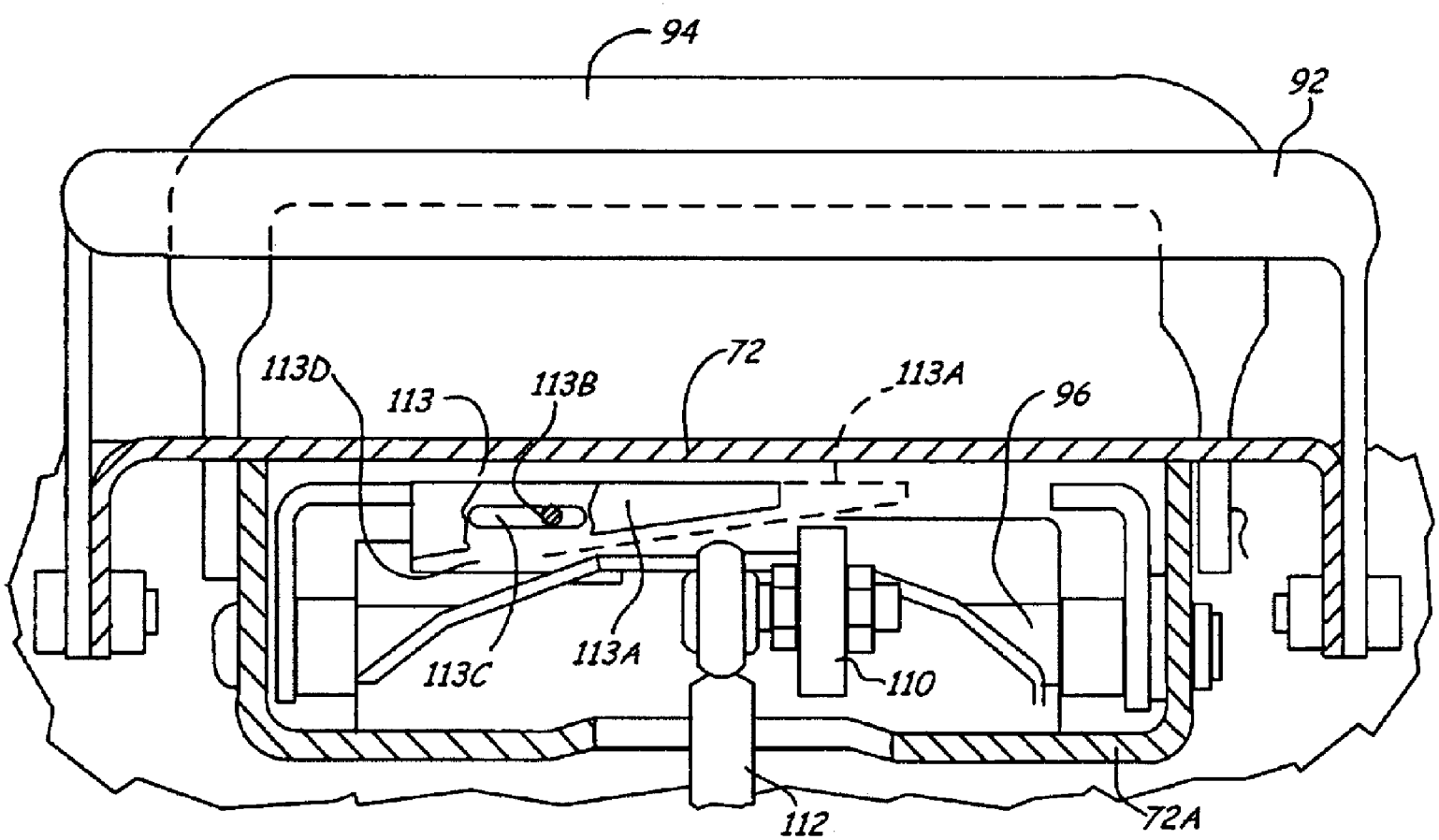
Fig. 9 PRIOR ART
FIG. 9 is a fragmentary sectional view of a different prior art form of a stop for limiting rearward displacement of the control handle.

A rearward stop for speed control is shown schematically in FIG. 8, wherein the control support plate 72 is shown fragmentarily with a depending flange 89 at the rear. Additionally, the lever 110 is provided with a rearwardly extending bracket having an upwardly extending flange 111 that is positioned just inside the flange 89, as can be seen in FIG. 7.

Flange 89 is provided with a horizontal slot 135, and a threaded pin 136 is locked in the slot. The pin can be adjusted along the length of the slot. The protrusion of the pin 136 is illustrated in FIG. 4, where the pin end is shown to extend inwardly past the upright extending flange 111.

Lock nuts shown at 137 can be used for holding the 136 pin axially in position, and the pin thus can be adjusted manually so that the position of the pin 136 along the slot 135 can be changed.

The horizontal slot 135 aligns with an open triangular-shaped recess 138 that is formed in the flange 111. The recess 138 has outwardly-extending, tapered edges 138A and 138B that are shown in dotted lines and in solid lines in FIG. 8. The edges extend from a center peak. Only one tapered edge needs to be provided.

Since the flange 111 will move up and down as the handle 94 is pivoted about the axis 98 of the pin 96, the protrusion of the stop pin 136 will engage one of the edges 138A or 138B, depending on the position of the pin, to stop movement of the handle rearwardly, and thus stop movement of the control levers for the pumps that regulate the speed of the motors.

While the showing in FIG. 8 is schematic, it can be seen that the triangular recess 138 can be open to the bottom, so that forward motion of the handle 94 which will raise the flange 111 is not restricted by the pin 136. Oppositely facing stop edges would be used for limiting forward speed.

The difference in the rearward speed can be adjusted, again, by moving the threaded stop pin 136, along the slot 135, and tightening it in position so that one edge 138A or 138B will engage the pin as the handle 94 is pivoted rearwardly to restrict rearward speed.

Again, only one inclined edge, such as 138A, can be used as a sole stop. The angle of inclination of the edge relative to the long axis of slot 135 will provide for the sensitivity of the adjustment in speed as the pin 136 is moved along the slot 135.

The rearward speed limiting control also can be accomplished with a wedge shaped stop 113A on the front of a plate 113 which is slidably mounted on the plate 72 for lateral movement. The wedge 113A has a tapered lower edge that engages the upper edge of the arm 110. This is shown schematically from the front in FIG. 9. The plate 113 can be retained laterally in position limiting movement of the upper edge of the front end of arm 110 with a bolt or hand screw 113B at the rear (where the pin 136 is located). The bolt 113B can slide laterally in a slot 113C that is on a depending flange 113D of plate 113 for adjustment of the rearward speed limiting position. The movement of the tapered lower edge of wedge 113A is similar to movement of one of the edges 138A and 138B.

It also can be noted that if the motor speed is at a maximum speed when the control handle 94 is centered about axis 82 (for straight ahead vehicle movement) and is all the way forward, steering movement with the control handle 94 all the way forward would be difficult. In order to provide a controlled maximum speed and still have the ability to change the direction of movement of the loader by increasing the speed of one of the drive motors and decreasing the speed of the other, linkage stops are provided on the hub or sleeve 80, which will engage the aligned side portions of the back panel 108C of the bracket 102.

As explained, the rotation of the support plate 72 is limited by the ends of slots 87A-87B in panel 70 being engaged by the spacers 85A-85B. Thus, the forward speed can be maintained while the sharpness of the turn is limited.

Referring to FIGS. 4 and 5, it can be seen that the sleeve 80 has a pair of laterally-extending ears on which threaded stop pins 140A and 140B are mounted. These pins protrude out to the rear of the sleeve 80, and are aligned with the back wall 108C of the bracket 102. In FIG. 4, the stop pin 140B is illustrated, and it can be seen that the end 141 of the stop pin 140B extends rearwardly of the sleeve 80. The end 141 of the pin will engage the inner surface of the rear wall 108C of the bracket 102, when the link 112 has been pushed downwardly so that the wall 108C pivots in toward the sleeve 80 in its lower portions. When the wall 108C engages the end portion 141 of either one of the stop pins 140A and 140B, or both, the position will result in the maximum straight ahead speed obtainable with movement of the handle 94 in a forward direction.

However, if the control levers 120A and 120B still are capable of being moved forwardly an additional selected amount, that means that the motors that are controlled by these levers 120A and 120B also can be run faster than the maximum speed controlled by the stop pins 140A and 140B. Thus, if forward movement of the handle 94 and thus the forward speed of the motor is at the stop position against the end portions 141 of the pins 140A and 140B, and the control support plate 72 is pivoted about the axis 82, the link 116B, for example, can move forwardly even though the bracket 102 cannot pivot about the horizontal axis 106 of pins 104 to move the wall 108C forwardly. At the same time, the link 116A would be moved rearwardly, and differential drive speed for the tracks or wheels is obtained for steering control.

Swinging the control support plate 72 in an opposite direction would cause the link 116A to move forwardly, and since the lever 120A is not at its maximum speed position, it can move forwardly and the lever 120B can move rearwardly.

This provides for steering even when the pre-set maximum forward speed is being traveled in a straight line forward direction.

Figure 6:
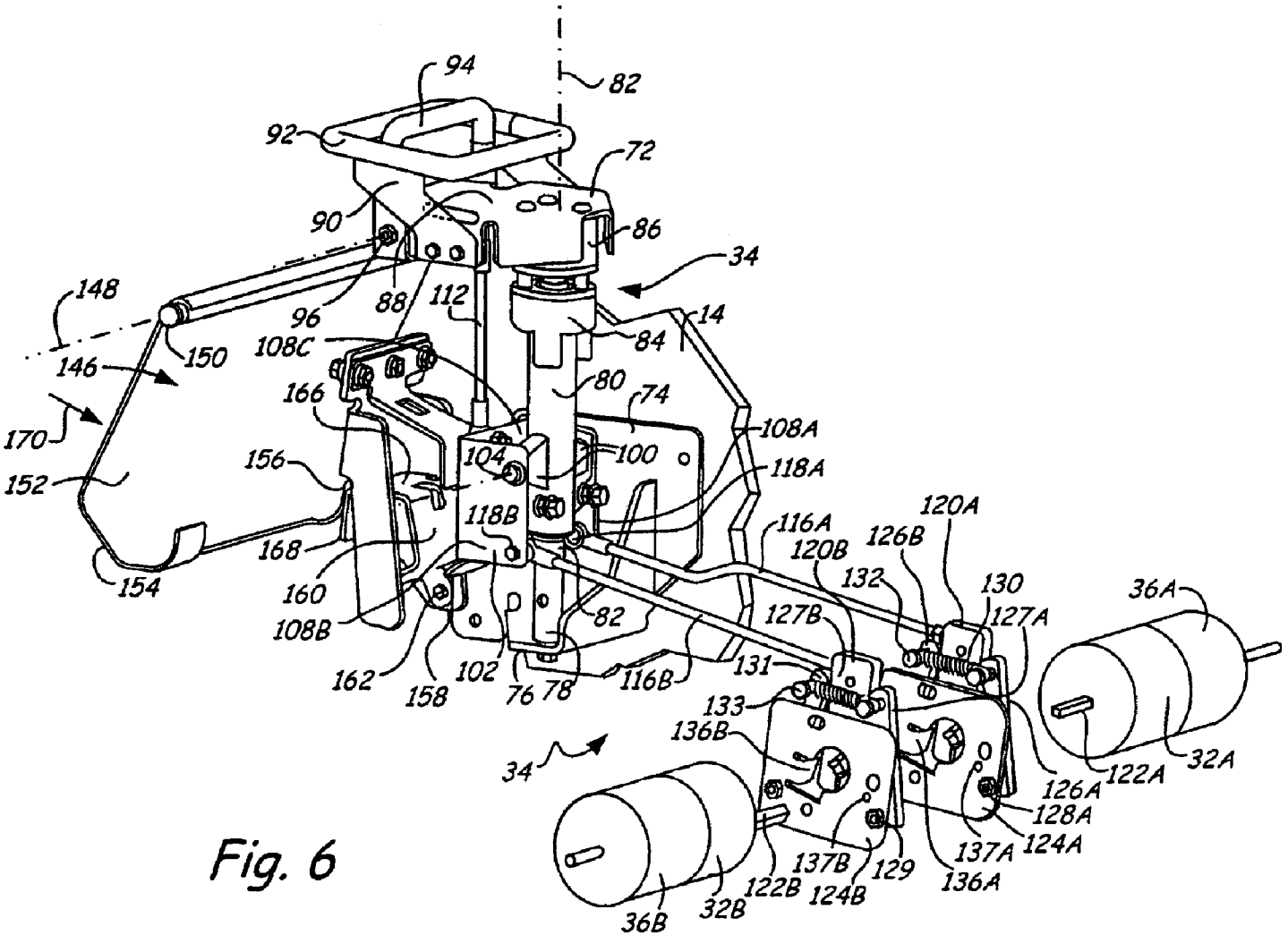
Fig. 6 PRIOR ART
FIG. 6 is a view similar to FIG. 5, showing an anti-reverse panel that moves the controls to a neutral position when engaging an object.

Additionally, a mechanical drive linkage disabling or disengagement (stop) panel is utilized at the rear of the loader. A reverse stop panel is disclosed in U.S. Pat. No. 6,902,016, issued Jun. 7, 2005, which is incorporated by reference. As shown, a panel 146 is pivotally mounted to the loader frame plates 14 and 16, or, if desired, to panel 70, about a horizontal axis 148 through suitable pins 150, as shown in FIG. 6. The panel 146 has a downwardly extending section 152, and a forwardly extending section 154 with one or more uprightly curved actuator fingers 156, at least one of which is in alignment with the shaft 78, and thus in alignment with the bracket 102. The mounting bracket 74 has a section 158 (FIG. 6) that supports a pivoting member 160 for pivoting about a horizontal axis with pins 162.

The bracket 160 has a rearwardly extending portion 166, and a downwardly extending actuator 168 that aligns with the center finger 156 on the panel 146. When a force such as that indicated by the arrow 170 engages the panel 146 on the vertical section 152, the panel 146 will pivot about the axis 148 in a direction that is toward the front of the loader and this will cause the finger 156 to act on the actuator 158 and in turn move the bracket 102 about its pivot so that the motor levers will move toward the front of the loader and will stop the rearward movement of the loader.

In this manner, the rearward movement of the loader can be automatically stopped if it engages an obstruction while it is moving rearwardly.

A panel like 146 also can be used at a forward end of a vehicle frame to stop forward drive if the vehicle engaged an object at a forward end of the frame.

The hand controls are illustrated at a rear of a loader for operator accessibility, but if the vehicle has an operator seat, the control system can be placed ahead of the operators seat in the mid-portions or front portion of the vehicle.

The pump and motor units, or other motor controls can be positioned to the rear of the hand controls, and to the rear of an operator that may be seated on the vehicle. The control links would be positioned at pivots located to provide forward and rearward movement of the vehicle when the control handle is moved forward and rearward.

Figure 10:
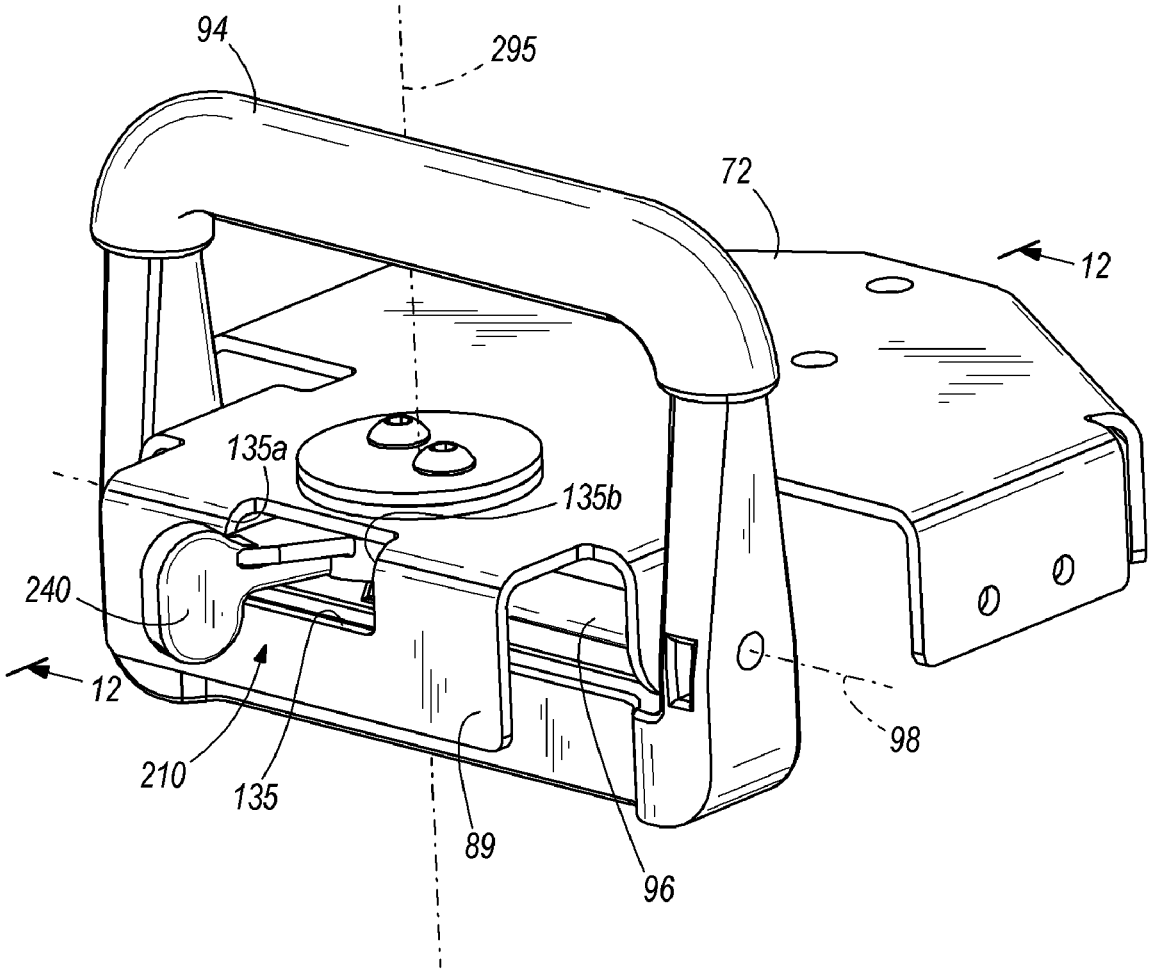
FIG. 10 is a perspective view of a control assembly for a vehicle such as the loader illustrated in FIG. 1, including a speed limiting control assembly embodying the present invention.
Figure 11:
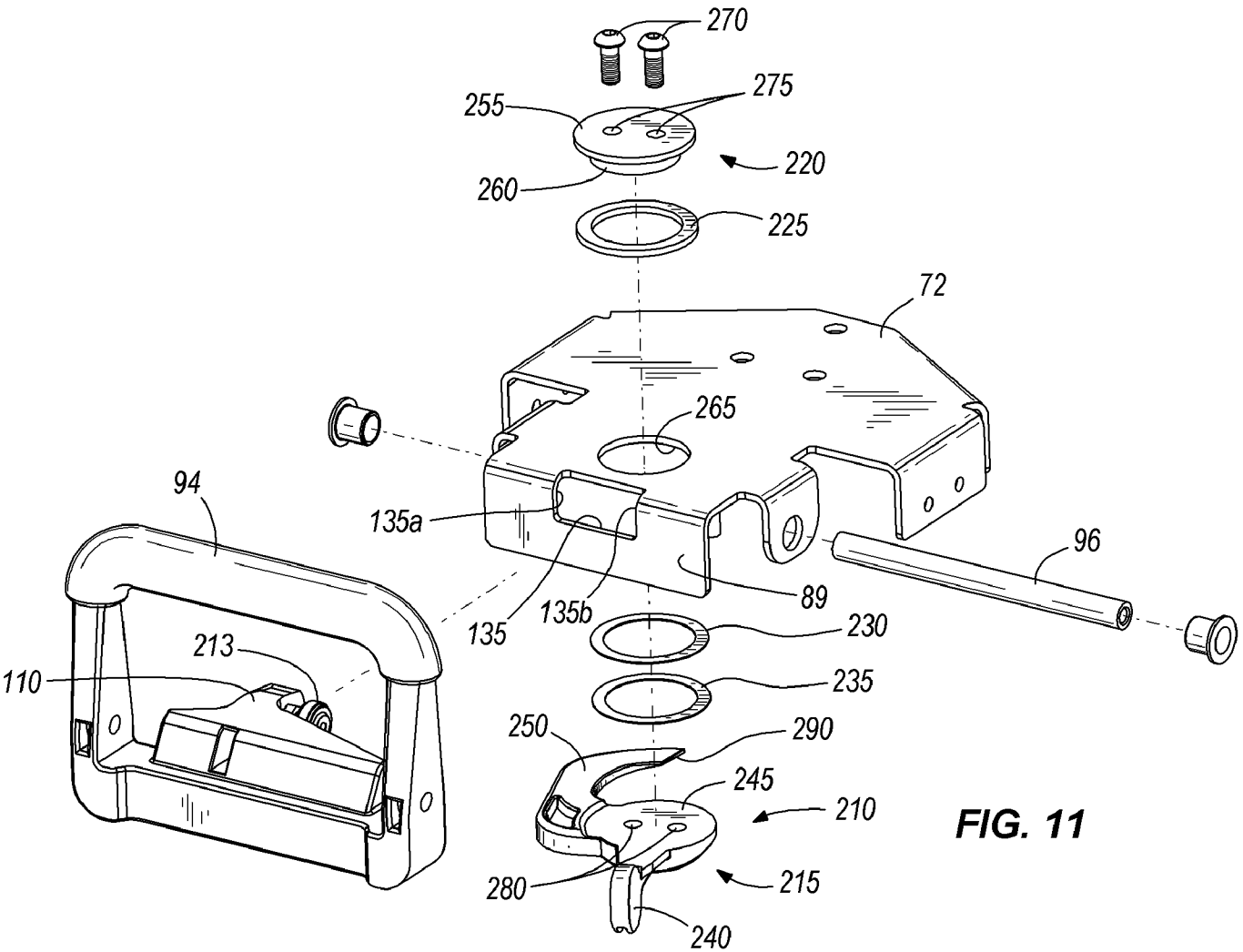
FIG. 11 is an exploded view of the control assembly of FIG. 10.
Figure 12A:
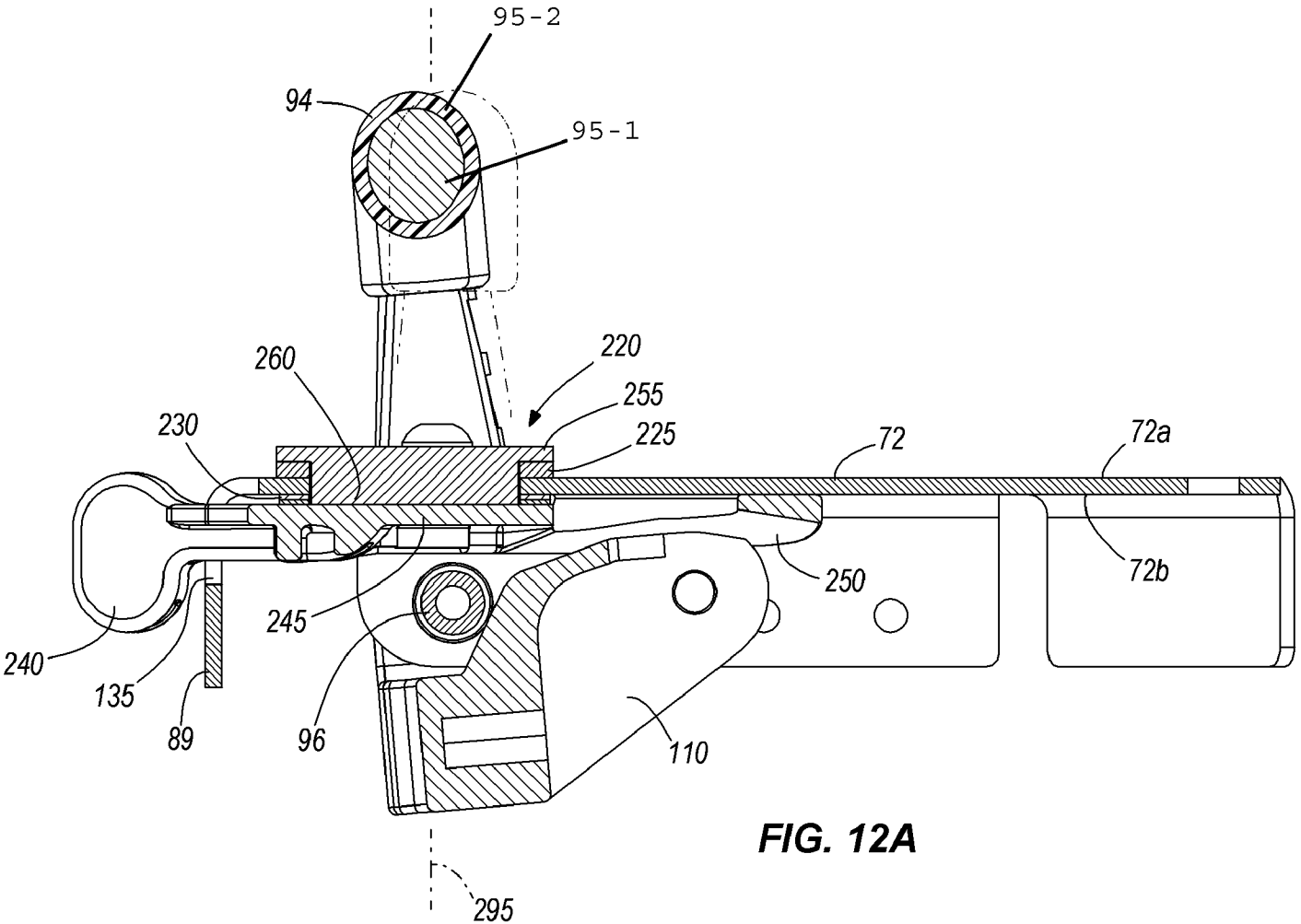
FIGS. 12A and 12B are cross-sectional views taken along section line 12-12 in FIG. 10, and illustrating the speed limiting control assembly in opposite extreme settings.
Figure 12B:
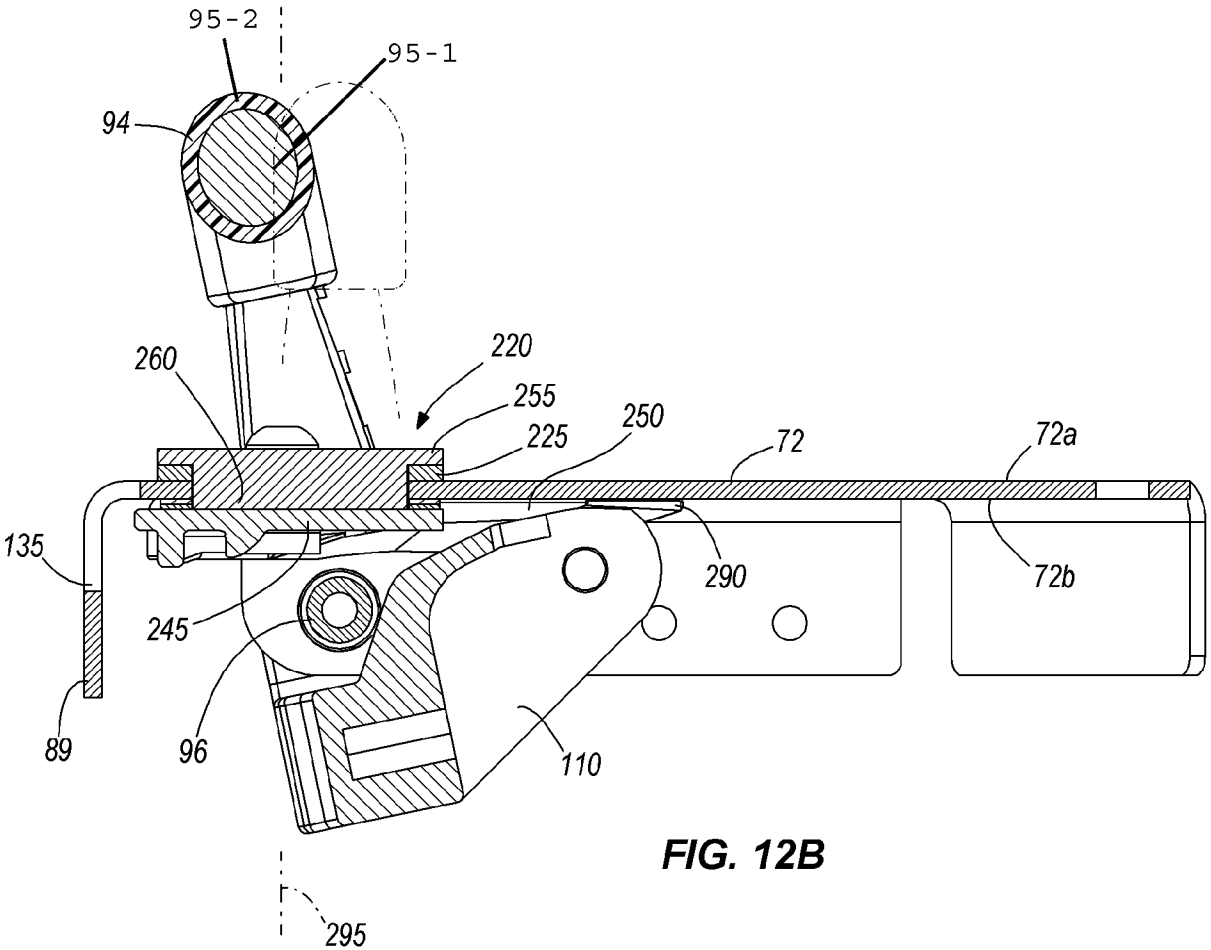

An alternate embodiment of a rear speed limiting mechanism is illustrated in FIGS. 10-12. In this alternate embodiment, the same reference numerals as used above are used for the same or substantially the same parts. In this embodiment, the handle 94 is configured with an overmold that includes a soft inner material 95-1 (shown in FIGS. 12A and 12B) for improved comfort and grip, and a tough, rugged outer layer 95-2 (shown in FIGS. 12A and 12B) that resists abrasion, oil, dirt, cold temps and environmental degradation such as exposure to sun and fading. By improving the operator's comfort and grip on the handle, the overmold permits the operator to work more hours without fatigue, and consequently improves the operator's productivity.

FIG. 10 illustrates the swinging or movable control handle support plate or platform 72 having top and bottom surfaces 72*a*, 72*b* (FIGS. 12A and 12B). The support plate 72 also includes the rear depending flange 89 as discussed above, and the flange 89 includes a slot 135 similar to that disclosed above. The slot has a first end 135*a* and a second opposite end 135*b*. Mounted to the support plate 72 and extending out of the slot 135 is an operator control or handle 240 (discussed below) of an alternate speed limiting control assembly 210. The handle 240 is movable between the first and second ends 135*a*, 135*b* of the slot 135 and positionable at either end 135*a*, 135*b*, or anywhere in between the ends 135*a*, 135*b*.

With reference to FIG. 11, the handle 94 includes a version of the arm 110 that includes a connection point 213 for the link 112. For the sake of this invention, the arm 110 is considered an engaging portion of the handle 94. The handle 94 is pivotable in reverse and forward directions, which correspond to counterclockwise and clockwise rotation, respectively, in FIGS. 12A and 12B.

Referring again to FIG. 11, the speed limiting control assembly 210 includes a first or main body 215, a second or capturing body 220, a friction washer or plate 225, a biasing member 230 and a washer 235. The main body 215 includes the above-mentioned handle 240, a mounting portion 245, and a cam member or portion 250. The main body 215 is integrally formed as one piece, and may be formed, for example, by injection molding a rigid plastic material. The cam member 250 of the main body 215 is positioned against the bottom surface 72*b* of the support plate 72, and the handle 240 extends through the slot 135. The second body 220 includes a flange portion 255 and a spacer portion 260. The spacer portion 260 extends through a hole 265 in the support plate 72, and has a lower surface that sits on the mounting portion 245 of the main body 215. The flange portion 255 is above and spaced apart from the support plate 72.

The friction washer 225 extends around the spacer portion 260 of the capturing body 220, and is sandwiched or captured between the top surface 72*a* of the support plate 72 and the bottom surface of the flange portion 255. The friction washer 225 may be made or constructed, for example, of a composite material that creates a high friction engagement with both the support plate 72 and the flange portion 255 of the capturing body 220. Constructing the friction washer 225 of a composite material will also guard against corrosion and seizing, and will ensure that the washer 225 is will rotate once the frictional engagement between the washer 225 and the support plate 72 or flange 255 is overcome.

The biasing member 230 may be, for example, a wave washer, a Bellville washer, or a split washer, and also extends around the spacer portion 260. The biasing member 230 is sandwiched or captured between the bottom surface 72*b* of the support plate 72 and the washer 235, which sits on a top surface of the mounting portion 245 of the main body 215.

A pair of fasteners 270, such as cap screws or bolts, extend through holes 275 the flange and spacer portions 255, 260 of the capturing body 220, and through aligned holes 280 in the mounting portion 245 of the main body 215. The bottom ends of the fasteners 270 are secured via nuts or a threaded interconnection with the holes 280 in the mounting portion 245. The fasteners 270 secure the first and second bodies 215, 220 for rotation together. As the fasteners 270 are tightened during assembly, the distance between the flange 255 and mounting portion 245 shrinks until the spacer 260 is securely held between the caps of the fasteners 270 and the mounting portion 245 of the main body 215.

When assembled, the biasing member 230 is compressed between the bottom surface 72*b* of the support plate 72 and the mounting portion 245 of the main body 215. The biasing member 230 applies a biasing force downwardly against the main body 215, away from the support plate 72. This biasing force is transmitted up through the fasteners 270 to the capturing body 220, and downwardly biases the flange portion 255 against the friction washer 225. The flange portion 255 therefore applies a normal force that holds the friction washer 225 against the top surface 72*a* of the support plate 72. The normal force gives rise to a high friction engagement between the friction washer 225 and the flange portion 255 and top surface 72*a* of the support plate 72. The high friction engagement requires high shear or torquing forces to cause pivotal movement of the friction washer 225 with respect to the support plate 72. Such high shear or torquing forces are not created during ordinary operation of the vehicle 10 through, for example, vibrations.

In other constructions, the fasteners 270 may be flipped so that the caps are against the bottom surface of the main body 215 and the threaded ends thread into holes 275 in the capturing body 220 or into nuts. Also in other embodiments, the friction washer 225 may engage the bottom surface 72*b* of the support plate 72 and the biasing member 230 may engage the top surface 72*a* of the support plate 72.

The cam member 250 describes a curve or hook and has top and bottom surfaces. The thickness of the cam member 250 is defined in terms of the distance between the top and bottom surfaces. The thickness of the cam member 250 ramps or tapers from being relatively thick at the junction of the cam member 250 and mounting portion 245 to being relatively thin at the distal end 290 of the cam member 250. Whatever portion of the cam member 250 in the path of the arm 110 as the handle 94 is pivoted may be called the stop portion (i.e., the thickness of the stop portion depends on the position of the cam member 250).

The speed limiting control assembly 210 is pivotable about a vertical axis of rotation 295 by virtue of the spacer portion 260 being positioned within the hole 265 in the support plate 72. The axis 295 is perpendicular to the axis 98 about which the handle 94 pivots on the pivot shaft 96. As the assembly 210 pivots about the axis 295, the thickness of the stop portion of the cam member 250 is adjusted. The handle 240 is may be moved from the first end 135*a* of the slot 135 (which corresponds to the thickest portion of the cam member 250 being positioned between the arm 110 and the bottom of the support plate 72) to the second end 135*b* of the slot 135 (which corresponds to the distal end 290 (i.e., the thinnest part) of the cam member 250 being positioned between the arm 110 and the bottom of the support plate 72).

The rearward range of motion of the handle 94 is dictated by the position of the speed limiting control assembly 210. In FIGS. 12A and 12B, the handle 94 is illustrated in a neutral position in phantom. The handle 94 may be pivoted in the reverse direction until the arm 110 abuts against the stop portion of the cam member 250. The range of motion of the handle 94 is therefore inversely proportional to the thickness of the stop portion (i.e., the thicker the stop portion, the smaller the range of motion of the handle 94).

As illustrated in FIG. 12A, when the handle 240 is moved to the first end 135*a* of the slot 135, the stop portion is at its thickest. Because the bottom surface 72*b* of the support plate 72 backs up the cam member 250, the bottom surface 72*b* may be termed an abutment surface. Positioning the thickest stop portion between the arm 110 and the support plate 72 minimizes the rearward or reverse range of motion of the control handle 94, and consequently minimizes the reverse speed attainable by the vehicle. On the other hand, when the handle 240 is pivoted to the second end 135*b* of the slot 135, as illustrated in FIG. 12B (in which the handle 240 is pivoted out of the page and thus not in the section view), the distal end 290 of the cam member 250 is positioned between the arm 110 of the control handle 94 and the bottom surface of the support plate 72 (i.e., the distal end 290 provides the stop portion). In other embodiments, the cam member 250 may be pivoted entirely out of the path of the arm 110 when the handle 240 is at the second end 135*b* of the slot 135, such that the control handle 94 can pivot even further in the reverse direction until the arm 110 abuts the bottom surface 72*b* of the support plate 72. This maximizes the rearward range of motion of the control handle 94, and consequently maximizes the reverse speed attainable by the vehicle 10.

Thus, when the handle 240 is at the first end 135*a* of the slot 135, reverse speed attainable by the vehicle 10 is minimized. As the handle 240 is moved from the first end 135*a* to the second end 135*b* of the slot, the maximum reverse speed attainable by the vehicle 10 increases until it is at a maximum when the handle reaches the second end 135*b*. The illustrated cam member 250 has a substantially linear taper, so maximum reverse speed increases substantially linearly as a function of the distance the handle 240 is moved away from the first end 135*a*. In other embodiments, the cam member 250 may have a non-linear profile and may include plateaus in which the thickness of the cam member 250 remains substantially constant.

The handle 240 may be set to any position between the ends 135*a*, 135*b* of the slot 135 with a single motion by the operator of the vehicle. The frictional engagement of the friction washer 225 against both the flange portion 255 and the top surface 72*a* of the support plate 72 resists movement of the speed limiting control assembly 210 under normal operating conditions of the vehicle. A side-to-side force applied to the handle 240 by the operator, however, is sufficient to overcome the frictional forces between the friction washer 225 and at least one of the flange portion 255 and the support plate 72. Once the operator has the speed limiting control assembly 210 in a desired position, the operator merely releases the handle 240, and the frictional forces maintain the assembly 210 in the desired position. Additionally, the biasing member 230 helps dampen vibratory forces that may otherwise overcome the frictional forces and cause the assembly 210 to drift out of the desired position.

In other embodiments, the speed limiting control assembly 210 may be modified to adjust the range of motion of the handle 94 in the forward direction, instead of or in addition to the reverse direction.

Various features and advantages of the invention are set forth in the following claims.

The invention claimed is:

1. A vehicle comprising:

an engine;

at least one driven wheel rotating under the influence of the engine to move the vehicle;

a speed control handle pivotable through a range of motion to control the rate of rotation of the driven wheel, the speed control handle including an engaging portion that moves along a path in response to pivoting of the speed control handle;

a cam member having varying thickness, a stop portion of the cam member being the portion of the cam member in the path of the engaging portion of the speed control handle for a given position of the cam member;

a frictional member creating sufficient frictional forces to resist movement of the cam member with respect to the rest of the vehicle during ordinary operation of the vehicle; and a handle manipulated by an operator of the vehicle to overcome the friction created by the frictional member and move the cam member into a desired position corresponding to a desired thickness of the stop portion to control speed limiting of the vehicle;

wherein the engaging portion of the speed control handle abuts against the stop portion of the cam member to define an end of the range of motion of the speed control handle such that the range of motion of the speed control handle is limited as a function of the thickness of the stop portion to limit speed of the vehicle.

2. The vehicle of claim 1, further comprising:

a support plate having first and second opposite sides;

a biasing member;

a first body capturing the frictional member between the first body and the first side of the support plate;

a second body capturing the biasing member between the second body and the second side of the support plate; and at least one fastener coupling the first and second bodies together to deflect the biasing member and increase friction between the frictional member and the first side of the support plate;

wherein the cam member and handle are both connected to and movable with one of the first and second bodies.

3. The vehicle of claim 2, wherein the cam member and handle are integrally formed with the second body.

4. The vehicle of claim 2, wherein the support plate includes a hole; wherein the first body includes a spacer extending through the hole; and wherein the second body defines a mounting portion against which the spacer is mounted.

5. The vehicle of claim 4, wherein the first body includes a flange; wherein the frictional member includes a friction washer surrounding a portion of the spacer; and wherein the frictional member is trapped between the flange and the first side of the support plate.

6. The vehicle of claim 5, wherein the biasing member includes a spring washer surrounding a portion of the spacer and compressed between the second side of the support plate and the second body.

7. The vehicle of claim 1, wherein the speed control handle includes an overmold constructed of a soft inner material surrounded by a tough, rugged outer layer to improve the comfort of an operator grasping the handle while resisting abrasion and environmental damage to the overmold.

8. A speed limit assembly for a vehicle having a support plate with first and second sides, and a speed control handle pivotable through a range of motion, the speed control handle having an engaging portion, the assembly comprising:

a cam member having varying thickness, a portion of the cam member in the path of the engaging portion of the speed control handle being a stop portion, the cam member being movable to adjust the portion of the cam member acting as the stop portion;

a frictional member coupled to the cam member and abutting against the first side of the support plate to create sufficient frictional forces to resist movement of the cam member with respect to the support plate during ordinary operation of the vehicle; and a handle manipulated by an operator of the vehicle to overcome the friction created by the frictional member and move the cam member into a desired position corresponding to a desired thickness of the stop portion to control speed limiting of the vehicle;

wherein the engaging portion of the speed control handle abuts against the stop portion of the cam member to define an end of the range of motion of the speed control handle such that the range of motion of the speed control handle and speed of the vehicle are limited as a function of the thickness of the stop portion.

9. The assembly of claim 8, further comprising:

a first body capturing the frictional member between the first body and the first side of the support plate;

a second body;

a biasing member captured between the second body and the second side of the support plate; and at least one fastener coupling the first and second bodies together to deflect the biasing member and increase friction between the frictional member and the first side of the support plate;

wherein the cam member and handle are both connected to and movable with one of the first and second bodies.

10. The assembly of claim 9, wherein the cam member and handle are integrally formed with the second body.

11. The assembly of claim 9, wherein the support plate includes a hole; wherein the first body includes a spacer extending through the hole; and wherein the second body defines a mounting portion against which the spacer is mounted.

12. The assembly of claim 11, wherein the first body includes a flange; wherein the frictional member includes a friction washer surrounding a portion of the spacer; and wherein the frictional member is trapped between the flange and the first side of the support plate.

13. The assembly of claim 12, wherein the biasing member includes a spring washer surrounding a portion of the spacer and compressed between the second side of the support plate and the second body.

* * * * *